US007334781B2

(12) United States Patent
Donnelly

(10) Patent No.: US 7,334,781 B2
(45) Date of Patent: Feb. 26, 2008

(54) SYSTEM AND METHOD FOR TREATING FUEL TO INCREASE FUEL EFFICIENCY IN INTERNAL COMBUSTION ENGINES

(76) Inventor: Joseph Louis Donnelly, 11302 Kendrick St. SW., Lakewood, WA (US) 98499

( * ) Notice: Subject to any disclaimer, the term of this patent is extended or adjusted under 35 U.S.C. 154(b) by 0 days.

(21) Appl. No.: 11/183,243

(22) Filed: Jul. 15, 2005

(65) Prior Publication Data

US 2006/0055067 A1 Mar. 16, 2006

Related U.S. Application Data

(63) Continuation-in-part of application No. 10/939,893, filed on Sep. 13, 2004, now abandoned.

(51) Int. Cl.
*B01F 3/04* (2006.01)

(52) U.S. Cl. ..... 261/90; 123/306; 366/305

(58) Field of Classification Search ..... 261/89, 261/90; 123/298, 306; 366/305
See application file for complete search history.

(56) References Cited

U.S. PATENT DOCUMENTS 2,803,309 A * 8/1957 Baker ..... 261/17
3,198,191 A * 8/1965 Wyszomirski ..... 126/247
3,273,549 A * 9/1966 Deland ..... 123/572
4,357,931 A * 11/1982 Wolpert et al. ..... 126/247
4,781,151 A * 11/1988 Wolpert et al. ..... 122/26
5,141,328 A * 8/1992 Dilley ..... 366/305
5,188,090 A * 2/1993 Griggs ..... 126/247
5,385,298 A * 1/1995 Griggs ..... 237/1 R
6,386,751 B1 * 5/2002 Wootan et al. ..... 366/170.3
6,627,784 B2 * 9/2003 Hudson et al. ..... 588/320
2002/0077373 A1 * 6/2002 Hudson et al. ..... 516/98

* cited by examiner

*Primary Examiner*—Richard L. Chiesa
(74) *Attorney, Agent, or Firm*—Olympic Patent Works PLLC

(57) ABSTRACT

Various embodiments of the present invention are directed to a system and method for increasing fuel efficiency in internal combustion engines by radially accelerating fuel prior to combustion. In one embodiment of the present invention, fuel is input, under pressure, to an enclosed fuel-acceleration chamber between a rotating rotor and stationary rotor housing. While in the acceleration chamber, the rotating rotor radially accelerates the fuel and the acceleration, in turn, may generate turbulence or cavitation within the fuel. The fuel is then output from the fuel-acceleration chamber to a treated-fuel reservoir and to a fuel-combustion site.

1 Claim, 19 Drawing Sheets

SYSTEM AND METHOD FOR TREATING FUEL TO INCREASE FUEL EFFICIENCY IN INTERNAL COMBUSTION ENGINES

CROSS-REFERENCE TO RELATED APPLICATION

This application is a continuation-in-part of application Ser. No. 10/939,893, filed Sep. 13, 2004, now abandoned.

TECHNICAL FIELD

The present invention relates to the field of internal combustion engines, and, in particular, to a system and method for treating fuel to increase fuel efficiency in internal combustion engines.

BACKGROUND OF THE INVENTION

Internal combustion engines are a vital part of modern society. Since development of the internal combustion engine, many internal-combustion-engine-based industries, such as the automobile industry, have devoted enormous amounts of money and resources toward research and development of various ways to increase the useful work realized from a given amount of fuel, or fuel efficiency. Designers and manufacturers of internal combustion engines have improved the fuel efficiency of internal combustion engines, and have improved the fuel used in internal combustion engines.

Internal combustion engines generally operate by combusting various hydrocarbon-based fuels that are refined from crude oil. Crude oil is believed to be a fossil fuel that is formed from plants and animals that once lived in ancient seas and that have decayed into hydrocarbons of various sizes and structures. Crude oil is refined and chemically processed into many different petroleum-based products, including: gasoline, diesel fuel, kerosene, jet fuel, lubricating oil, gas oil, plastics and other polymers, asphalt, and wax.

Crude oil refining, in part, consists of separating variable-sized hydrocarbons into fractions, each fraction containing similarly-sized hydrocarbons within a narrow range of volatility. Hydrocarbons contain potential energy that is released during the internal combustion process within internal combustion engines. The fuel efficiency of current internal combustion engines remains significantly below the theoretical, thermodynamic maximum obtainable efficiency. Designers, manufacturers, and consumers of internal combustion engines have, therefore, recognized the need for further improvements to internal combustion engines and fuel in order to increase the fuel efficiency of internal combustion engines.

SUMMARY OF THE INVENTION

Various embodiments of the present invention are directed to a system and method for increasing fuel efficiency in internal combustion engines by radially accelerating fuel prior to combustion. In one embodiment of the present invention, fuel is input, under pressure, to an enclosed fuel-acceleration chamber between a rotating rotor and stationary rotor housing. While in the acceleration chamber, the rotating rotor radially accelerates the fuel and the acceleration, in turn, may generate turbulence or cavitation within the fuel. The fuel is then output from the fuel-acceleration chamber to a treated-fuel reservoir and to a fuel-combustion site.

DETAILED DESCRIPTION OF THE INVENTION

Various embodiments of the present invention are directed to a system and method to increase fuel efficiency in internal combustion engines by radially accelerating hydrocarbon-based fuel input to a fuel-treatment assembly prior to combustion. In one embodiment of the present invention, fuel is input to a fuel-acceleration chamber within a fuel-treatment assembly. A fuel-treatment assembly includes a rotor, a surrounding rotor housing, and two flanking rotor-housing caps. The fuel-acceleration chamber within the fuel-treatment assembly is a fuel-tight space bounded on the inside by the rotor, on the outside by the rotor housing, and on the sides by the flanking rotor-housing caps. Fuel is input to the fuel-acceleration chamber through intake ports in the rotor-housing caps and radially accelerated by rapid rotation of the rotor. Turbulent flows, and possibly cavitation, are produced by shear forces produced within the fuel. The shear forces result from the extremely large gradient in flow rate across the narrow width of the acceleration chamber, from the stationary rotor housing to the rotor, as fuel contacts recesses in the rotating rotor surface. Treated fuel is then output, through an outtake port in the rotor housing, to a treated-fuel reservoir where the treated fuel is subsequently passed to a fuel-combustion site, such as a combustion chamber of an internal combustion engine.

Figure 1A:
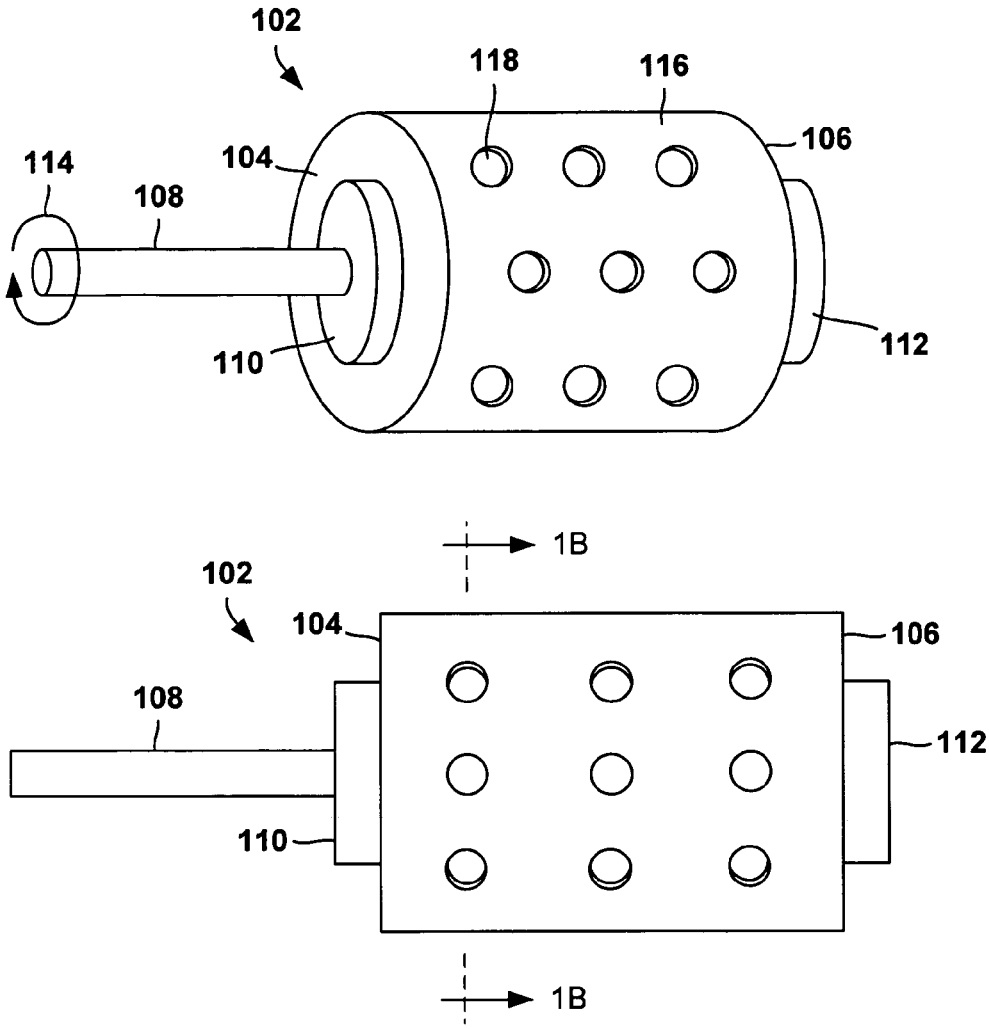
FIG. 1A shows a perspective view and a side view of one embodiment of a rotor and spindle shaft of a fuel-treatment assembly.

FIG. 1A shows a perspective view and a side view of one embodiment of a rotor and spindle shaft of a fuel-treatment assembly. Rotor 102 is approximately cylindrical in shape, with closed ends 104 and 106. Spindle shaft 108 extends through rotor 102, passing through closed ends 104 and 106, and is held in place by bearings 110 and 112. When spindle shaft 108 is connected with a motor (not shown in FIG. 1A), rotor 102 rotates with spindle shaft 108, as shown by directional arrow 114. Directional arrow 114 shows spindle shaft 108 rotating in a clockwise direction. The direction shown is arbitrary. A motor can be attached to spindle shaft 108 to rotate the rotor in either a clockwise or a counter-clockwise direction. Rotor surface 116 contains a series of recesses, such as recess 118.

Figure 1B:
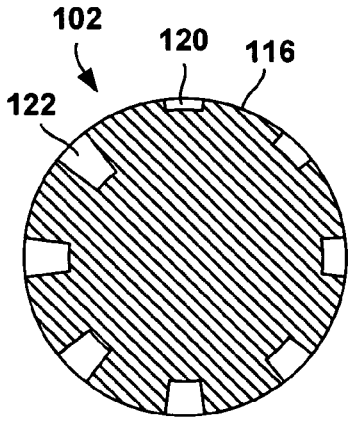
FIG. 1B shows a cross-sectional view of the rotor embodiment shown in FIG. 1A.

FIG. 1B shows a cross-sectional view of the rotor embodiment shown in FIG. 1A. Rotor surface 116 includes a series of recess rows of similar depth, such as recess row 120. Moving in a clockwise direction around the cross-sectional view of rotor 102, from recess row 120 to recess row 122, each successive recess row has an increasingly greater depth than the previous recess row. The specific configuration of recesses shown on rotor surface 116 is one of many possible surface features that may effectively contribute to fuel treatment. Recess depths can be varied in any number of different ways, or not varied at all. Additionally, the sizes and shapes of the recesses may be varied. Protruding shapes, or protuberances, can be used instead of recesses. Grooves may be used as well. Recesses, protuberances, and grooves can additionally be used together, or in some combination.

Figure 2A:
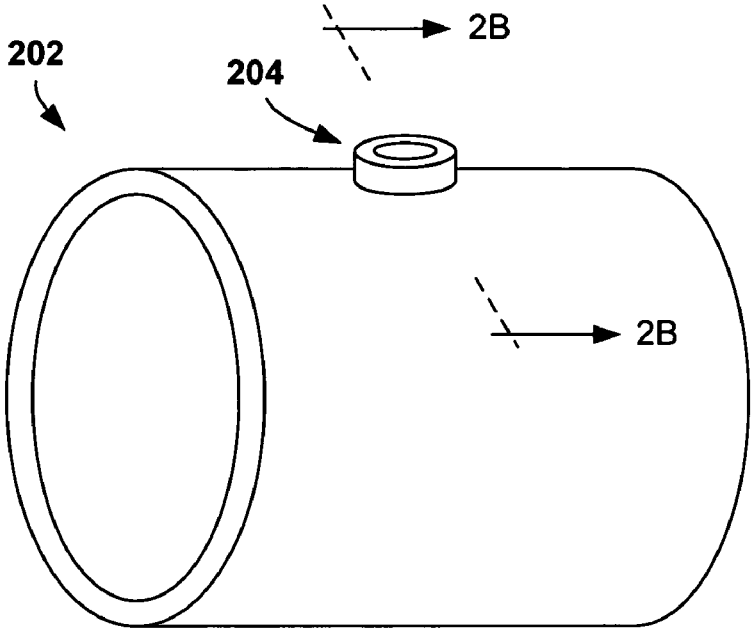
FIG. 2A shows a perspective view of one embodiment of a rotor housing for a fuel-treatment assembly.
Figure 2B:
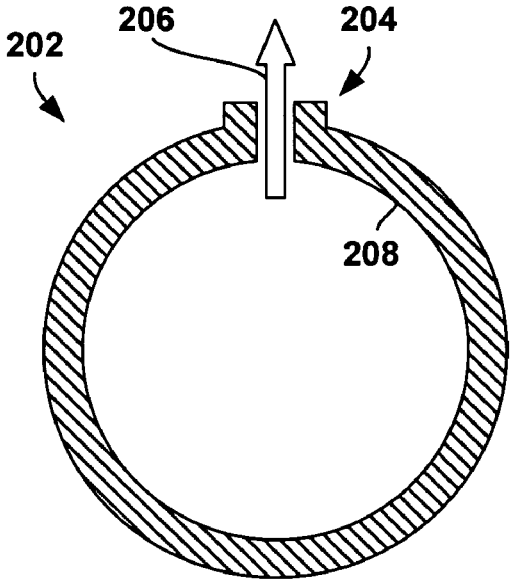
FIG. 2B shows a cross-sectional view of the rotor housing embodiment shown in FIG. 2A.

FIG. 2A shows a perspective view of one embodiment of a rotor housing for a fuel-treatment assembly. Rotor housing 202 is an open-ended cylinder that includes outtake port 204. The diameter of rotor housing 202 is larger in size than the diameter of a corresponding rotor (102 in FIG. 1A) so that the rotor can be placed inside of rotor housing 202. FIG. 2B shows a cross-sectional view of the rotor housing embodiment shown in FIG. 2A. Outtake port 204 extends through rotor housing 204, allowing fluid passage from the interior of rotor housing 202, through outtake port 204, in the direction identified by directional arrow 206. In one embodiment of the present invention, outtake port 204 has a diameter of approximately 0.375 inches.

As discussed above, when a rotor is placed within a rotor housing, a fuel-acceleration chamber is created between the outer surface of the rotor and the inner surface of the rotor housing. The inner surface of the fuel-acceleration chamber is rotor surface (116 in FIG. 1A) and the outer surface is the inner surface of the rotor housing (208 in FIG. 2B). In FIG. 2B, rotor housing surface 208 is shown with no recesses, protuberances, grooves, or other such surface features. However, rotor housing surface 208 can include recesses, protuberances, and grooves, just as the rotor surface (116 in FIG. 1A), discussed above, can include recesses, protuberances, and grooves. Moreover, surface features can be included on either, both, or neither of the rotor surface and the rotor housing surface.

Figure 3A:
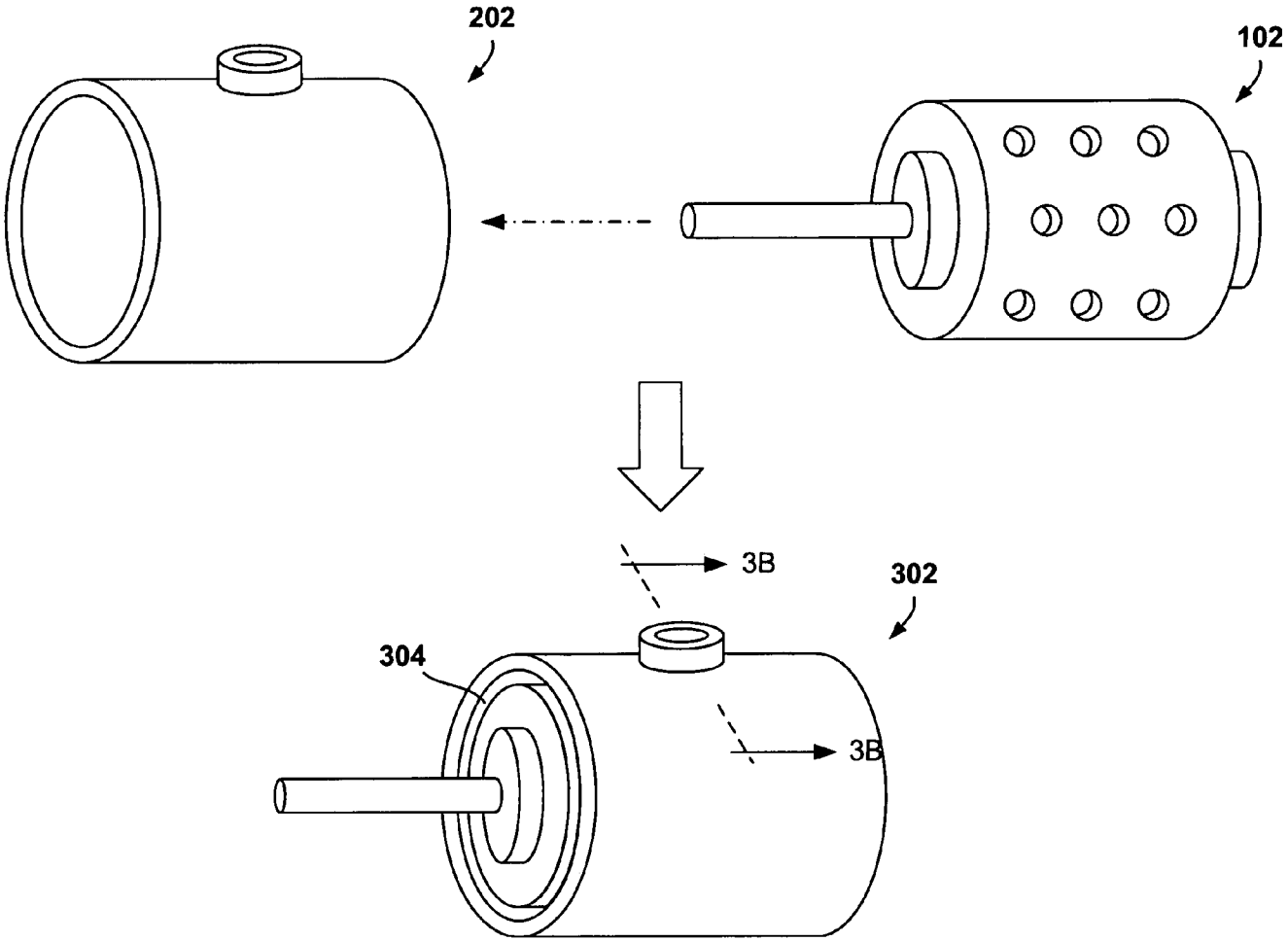
FIG. 3A shows one embodiment of a rotor and spindle shaft placed within one embodiment of a rotor housing to form a chamber.
Figure 3B:
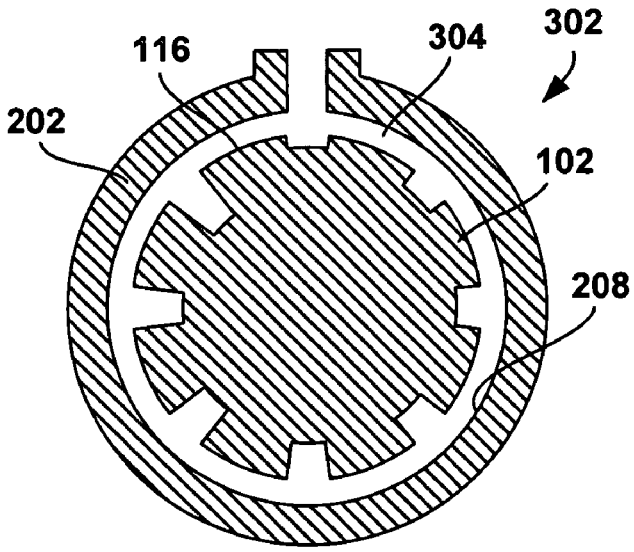
FIG. 3B shows a cross-sectional view of the fuel-acceleration chamber shown in FIG. 3A.

FIG. 3A shows one embodiment of a rotor and spindle shaft placed within one embodiment of a rotor housing to form a fuel-acceleration chamber. Rotor 102 can be placed inside rotor housing 202 to form rotor/rotor-housing combination 302. The outer diameter of rotor 102 is smaller than the inner diameter of rotor housing 202, providing enough room for rotor 102 to be placed within rotor housing 202 while still allowing space between rotor 102 and rotor housing 202. The space between rotor 102 and rotor housing 202 forms fuel-acceleration chamber 304. FIG. 3B shows a cross-sectional view of the fuel-acceleration chamber shown in FIG. 3A. In one embodiment of the present invention, the distance between the outer rotor surface and the inner rotor housing surface is approximately 0.1 inches.

Figure 4:
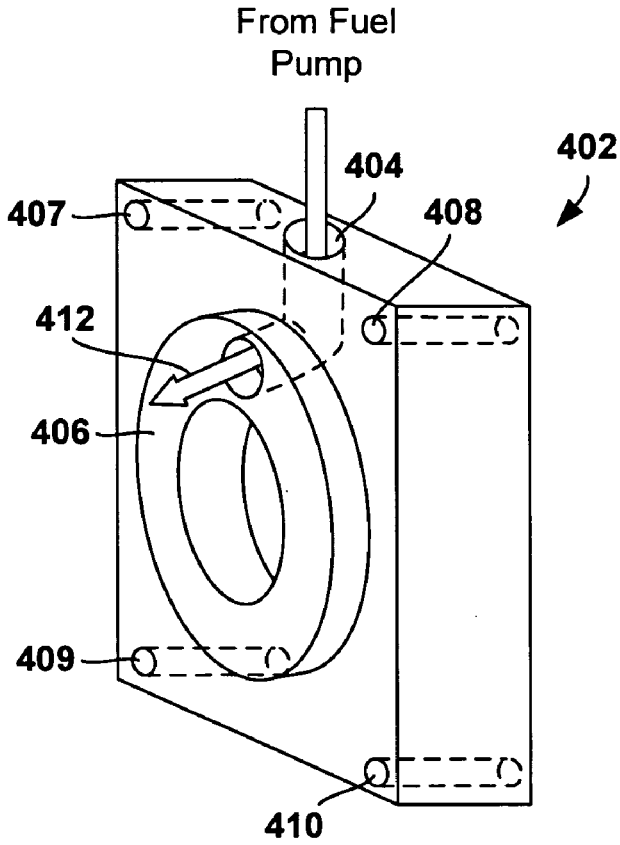
FIG. 4 shows a perspective view of one embodiment of a first rotor-housing cap for a fuel-treatment assembly.

FIG. 4 shows a perspective view of one embodiment of a first rotor-housing cap for a fuel-treatment assembly. First rotor-housing cap 402 includes first intake port 404, first positioner 406, and end-piece-attachment bolt holes 407-410. First intake port 404 passes fuel from an external source to the chamber (304 in FIGS. 3A-3B) of the fuel-treatment assembly, as shown by directional arrow 412. Fuel is generally input to the first intake port 404 through a closed system that includes a fuel pump (not shown in FIG. 4) for maintaining a constant fuel pressure. In one embodiment of the present invention, fuel with an input fuel pressure of approximately 4 pounds per square inch ("PSI") is input to first intake port 404, which has a diameter of approximately 0.25 inches.

First intake port 404 is positioned so that, when a rotor housing and enclosed rotor are positioned against first rotor-housing cap 402, fuel passed through first intake port 404 enters the acceleration chamber. First positioner 406 positions the rotor housing and enclosed rotor against first rotor-housing cap 402 to maintain a stable and snug fit. O-rings and bushings (not shown in FIG. 4) can be placed along first positioner 406 to create a fuel-tight seal between first rotor-housing cap 402 and the rotor housing and enclosed rotor to prevent fuel leakage from the acceleration chamber. Four bolts fitted through a first set of end-piece-attachment bolt holes 407-410 and a second set of four bolt holes on a second rotor-housing cap (not shown in FIG. 4) aligned with the first set of bolt holes are used, in one embodiment of the present invention, to hold the fuel-treatment assembly, including two rotor-housing caps, a rotor housing and an enclosed rotor, together.

Figure 5:
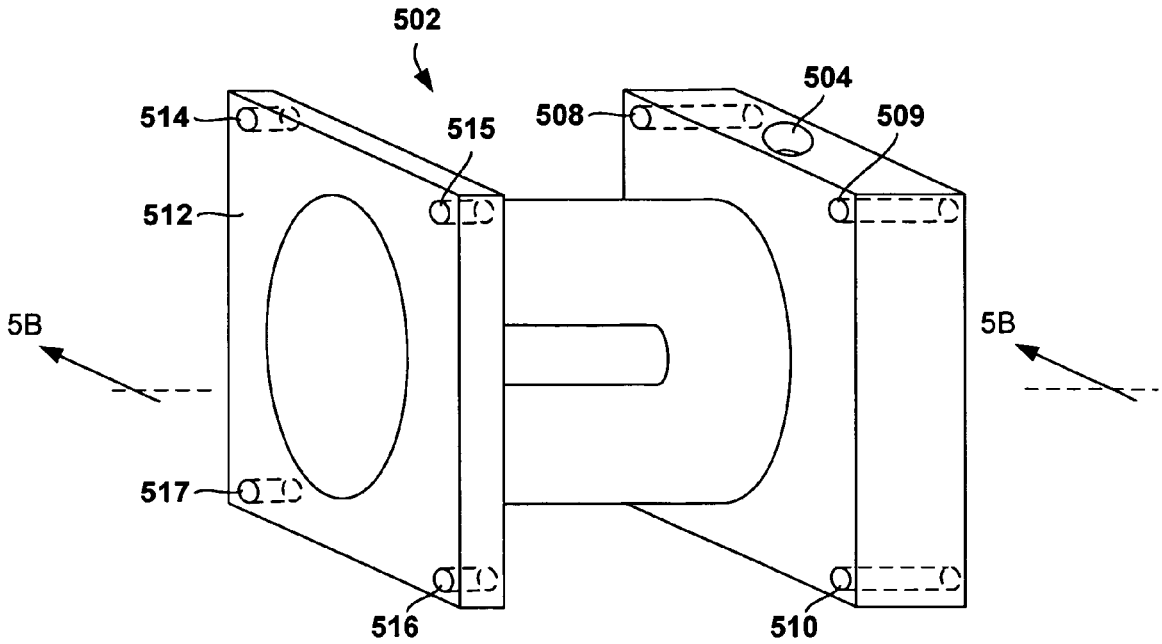
FIG. 5 shows a perspective view and a cross-sectional view of one embodiment of a second rotor-housing cap for a fuel-treatment assembly.
Figure 5:
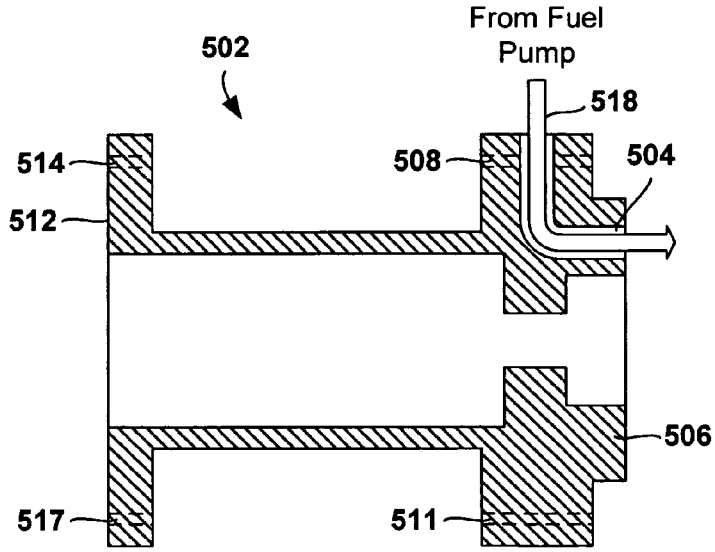

FIG. 5 shows a perspective view and a cross-sectional view of one embodiment of a second rotor-housing cap for a fuel-treatment assembly. Second rotor-housing cap 502 includes second intake port 504, second positioner 506, end-piece-attachment bolt holes 508-511, motor mount 512, and motor-mount bolt holes 514-517. Second intake port 504 passes fuel from an external source to the fuel-acceleration chamber (304 in FIGS. 3A-3B), as shown by directional arrow 518. Fuel is generally input to second intake port 504 through a closed system that includes a fuel pump (not shown in FIG. 5) that maintains a constant fuel pressure. In one embodiment of the present invention, fuel with an input fuel pressure of approximately 4 PSI is input to second intake port 504, which has a diameter of approximately 0.25 inches.

Second intake port 504 is positioned so that, when a rotor housing and enclosed rotor are positioned against second rotor-housing cap 502, fuel passed through second intake port 504 enters the acceleration chamber. Second positioner 506 positions the rotor housing and enclosed rotor against second rotor-housing cap 502 to maintain a stable and snug fit. O-rings and bushings (not shown in FIG. 5) can be placed along second positioner 506 to create a fuel-tight seal between second rotor-housing cap 502 and the rotor housing with enclosed rotor to prevent fuel leakage from the fuel-acceleration chamber.

Motor mount 512 connects the current embodiment of the present invention to a motor that rotates a spindle shaft and rotor. Various types of motors can be used. Motors can rotate a spindle shaft directly, or can rotate a spindle indirectly through various forms of connection, including: shafts, belts, gears, cogs, or other forms of connection. Motor-mount bolt holes 514-517 can be aligned with bolt holes on a motor rotor housing (not shown in FIG. 5) to allow connection of the motor and fuel-treatment assembly, via four bolts. In the described embodiment of the present invention, rotor 102 is powered by the motor to between 2000 and 3000 revolutions per minute ("RPM").

Figure 6:
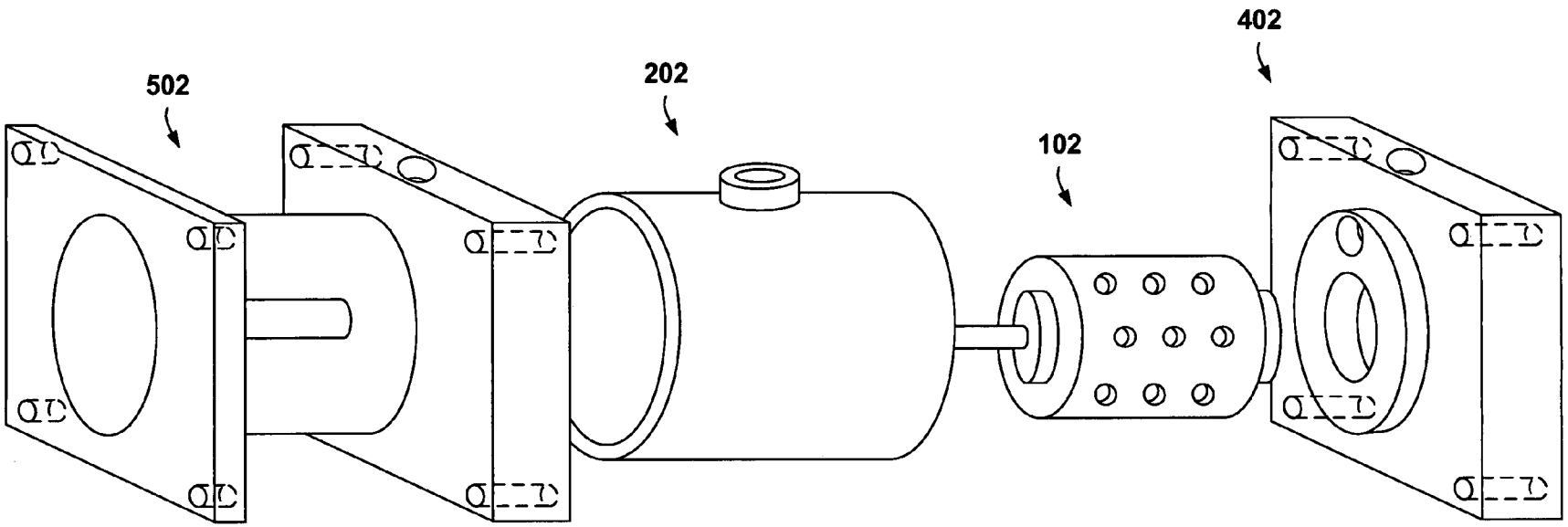
FIG. 6 shows an exploded view of one embodiment of a fuel-treatment assembly.
Figure 7A:
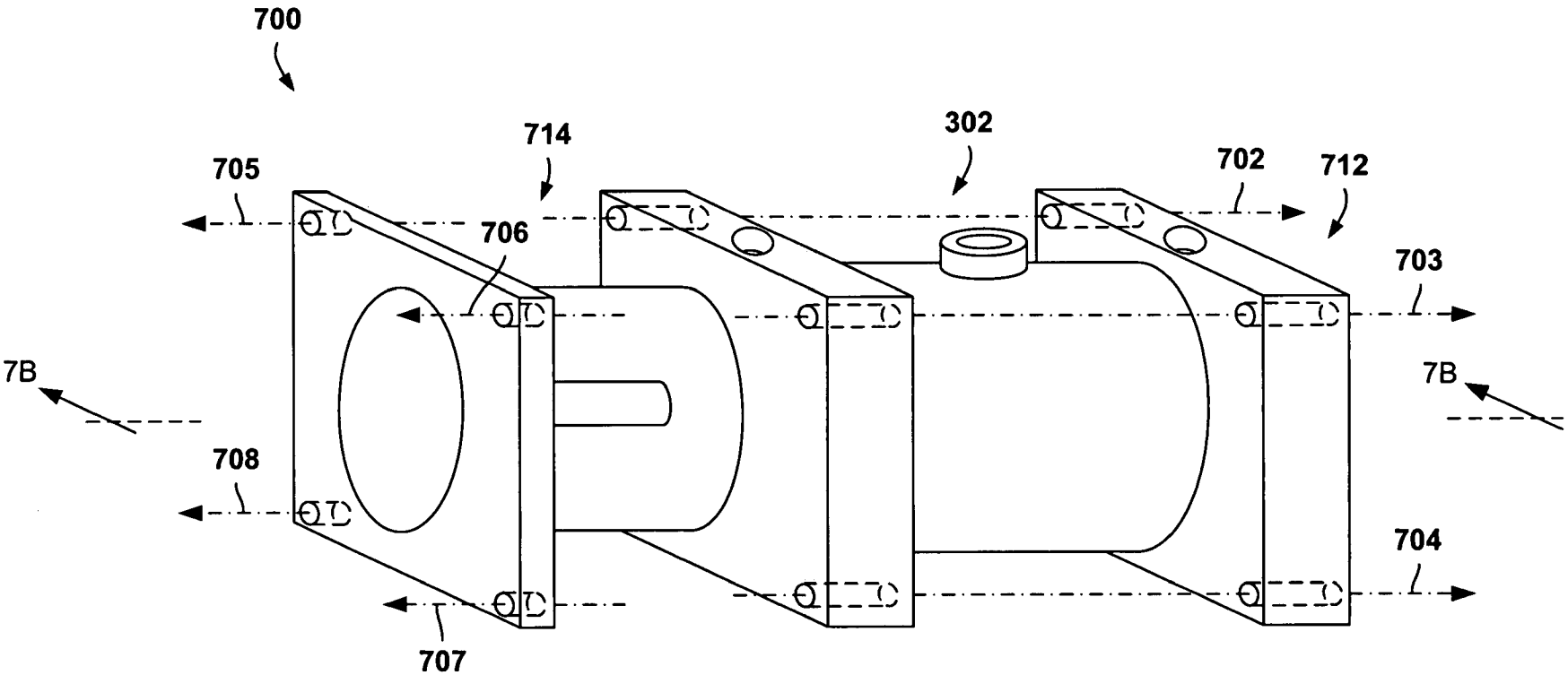
FIG. 7A shows a perspective view of one embodiment of a fuel-treatment assembly.

FIG. 6 shows an exploded view of one embodiment of a fuel-treatment assembly. Rotor 102 and rotor housing 202 are shown flanked on one side by first rotor-housing cap 402, and on the opposite side by second rotor-housing cap 502. FIG. 7A shows a perspective view of one embodiment of a fuel-treatment assembly. Fuel-treatment assembly 700 includes rotor/rotor-housing combination 302, which is attached on one end to first rotor-housing cap 402 and on the opposite end to second rotor-housing cap 502. End-piece-attachment arrows 702-704 and rotation-source-mount arrows 706-709 show the placement of bolts through bolt holes. Note that there is an additional pair of bolt holes that are not shown in FIG. 7 that can be used to connect the bottom left corner of first rotor-housing cap 402 to second rotor-housing cap 502.

Figure 7B:
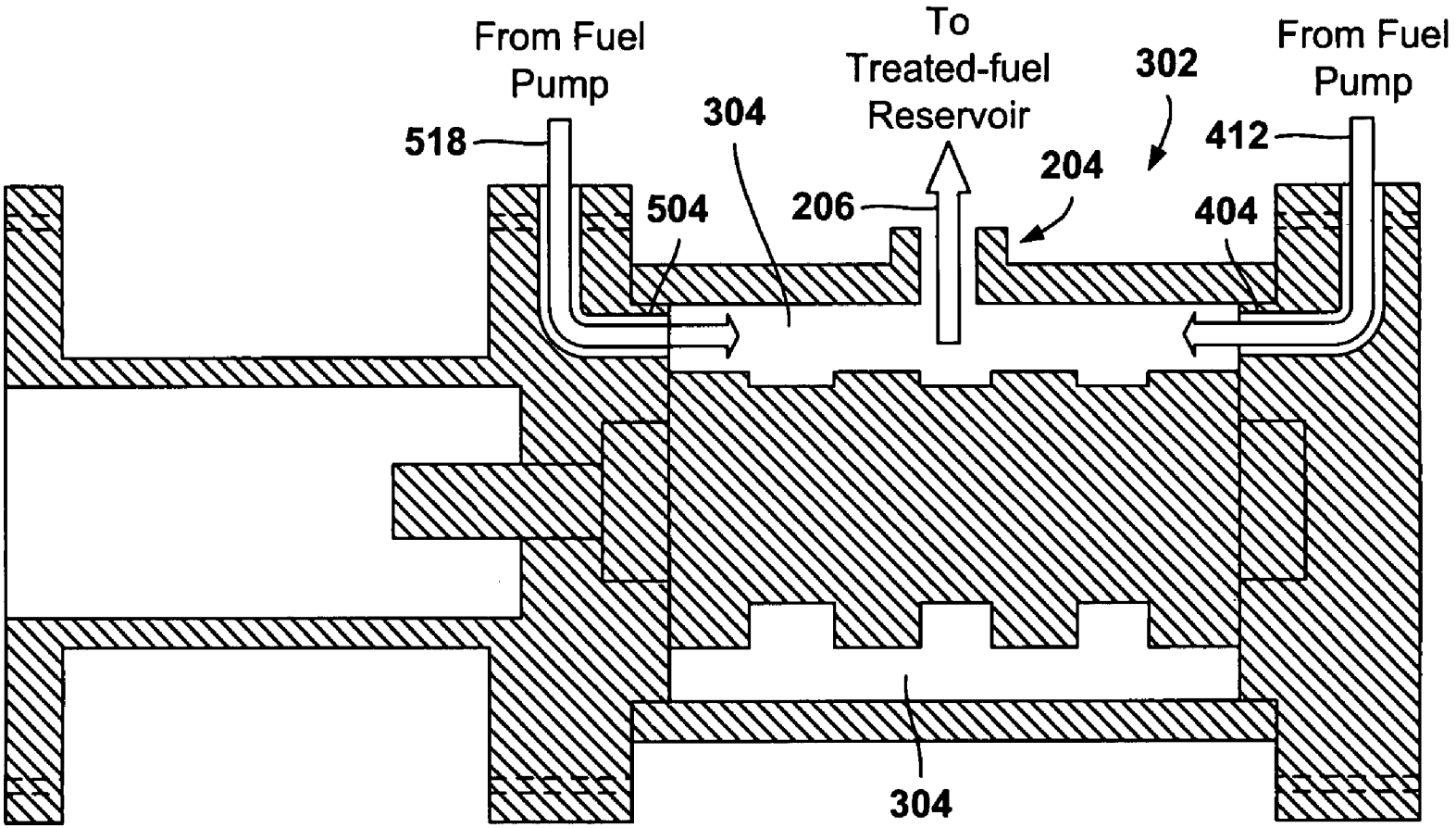
FIG. 7B shows a cross-sectional view of the fuel-treatment-assembly embodiment shown in FIG. 7A.

FIG. 7B shows a cross-sectional view of the fuel-treatment-assembly embodiment shown in FIG. 7A. Fuel is input to fuel-acceleration chamber 304 within rotor/rotor-housing combination 302 via two intake ports: first intake port 404, and second intake port 504. Directional arrows 412 and 518 show the direction of flow of fuel entering fuel-acceleration chamber 304 via first intake port 404 and second intake port 504, respectively. Treated fuel is output from fuel-acceleration chamber 304, via outtake port 204, as shown by directional arrow 206.

Figure 8A:
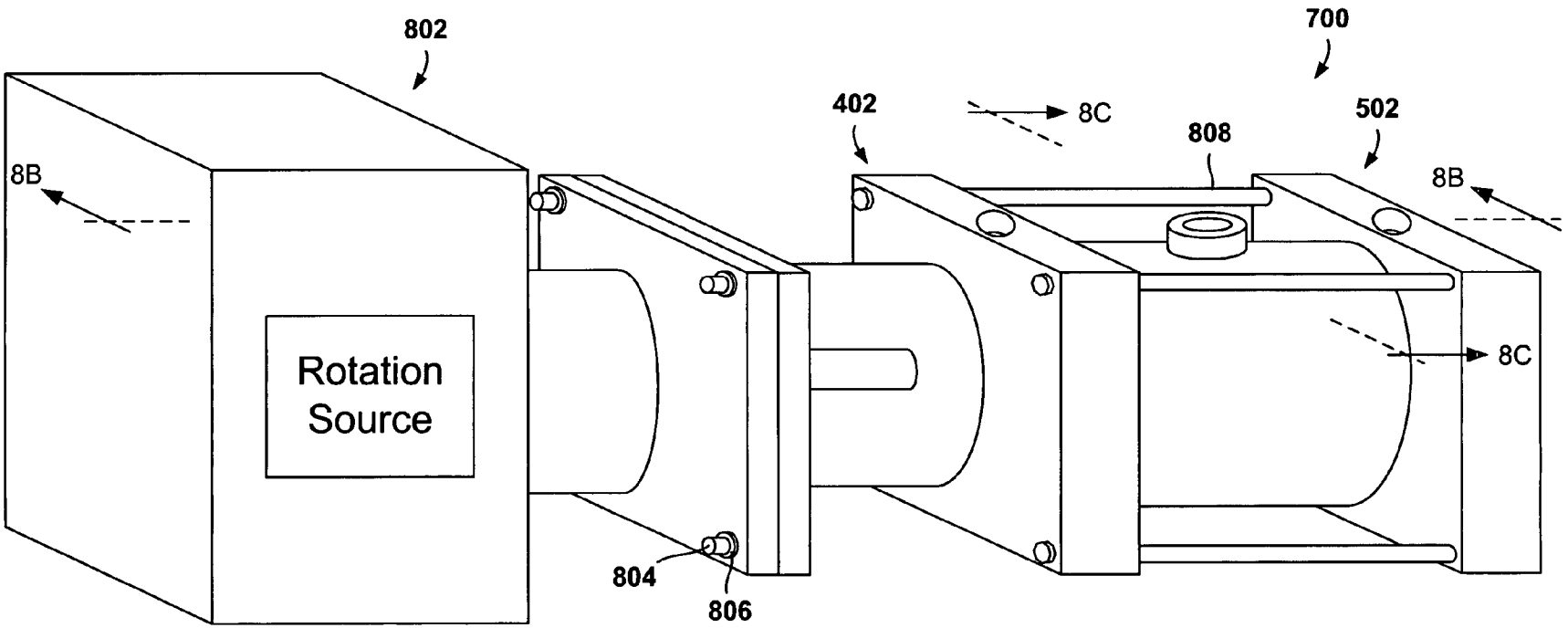
FIG. 8A shows a perspective view of the fuel-treatment-assembly embodiment shown in FIGS. 7A-7B with the addition of a motor.
Figure 8B:
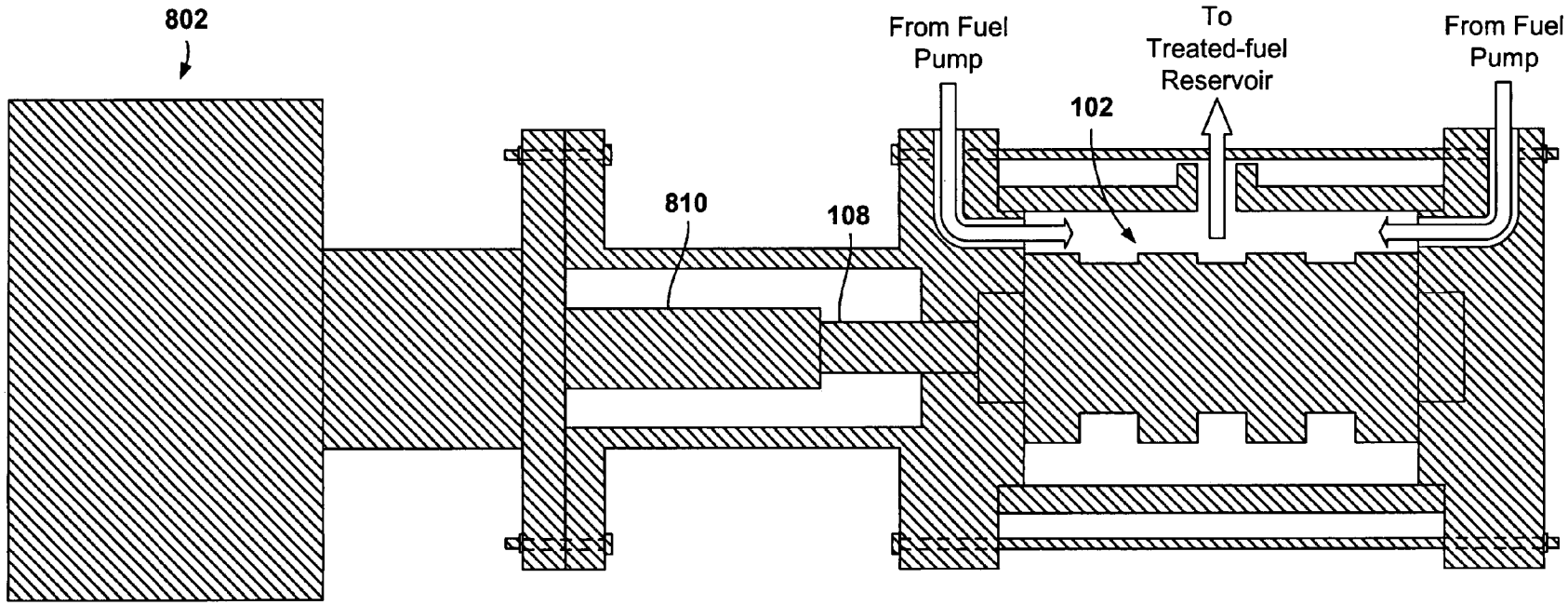
FIG. 8B shows a cross-sectional view of the fuel-treatment-assembly embodiment shown in FIG. 8A.
Figure 8C:
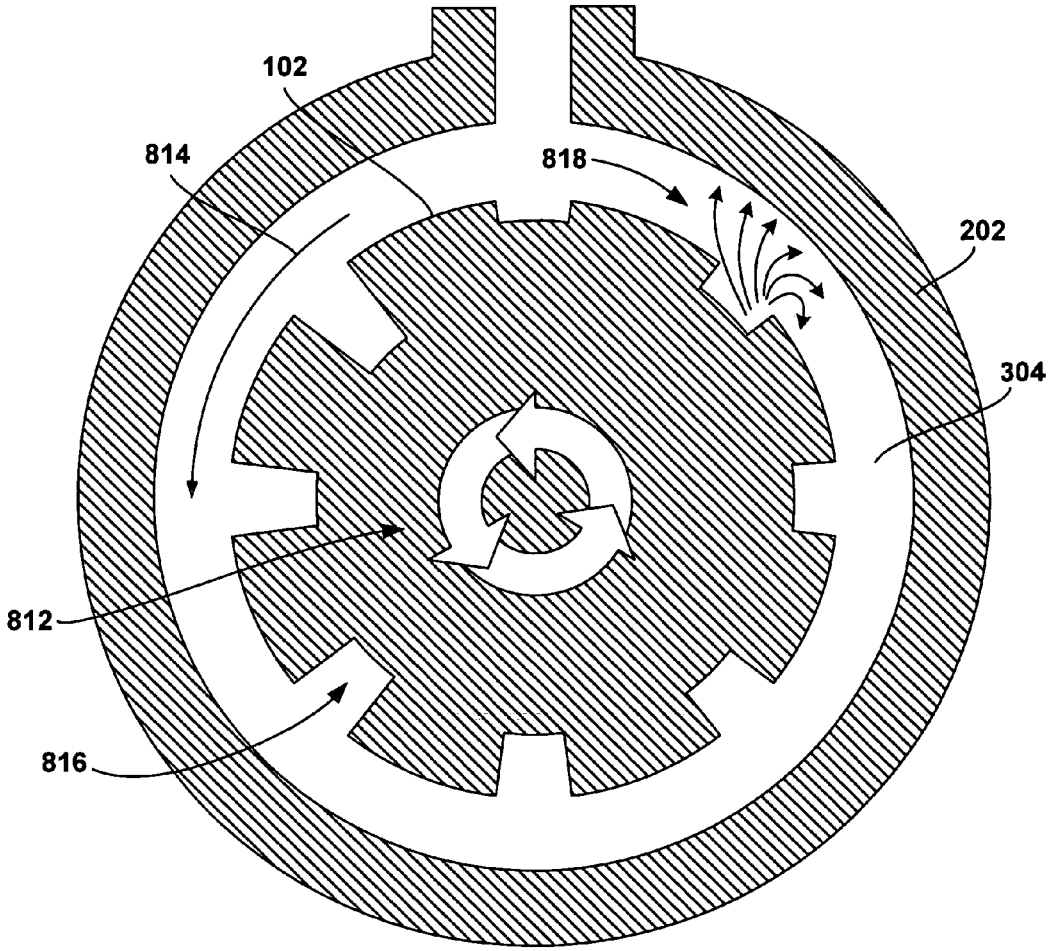
FIG. 8C shows a cross-sectional view of the fuel-acceleration chamber shown in FIG. 8A.

FIG. 8A-8C show the fuel-treatment assembly described with reference to FIGS. 7A-7B, with a motor mounted to the second rotor-housing cap. FIG. 8A shows a perspective view of the fuel-treatment-assembly embodiment shown in FIGS. 7A-7B with a motor. Fuel-treatment assembly 700 is shown with motor 802 mounted to the fuel-treatment assembly by bolts and lock washers, such as bolt 804 and lock washer 806. Motor 802 is connected to a spindle shaft (108 in FIG. 1A) within second rotor-housing cap 502. Motor 802 rotates the spindle shaft (108 in FIG. 1A), in turn the rotating rotor (102 in FIG. 1A) within the rotor housing. First rotor-housing cap 402 is shown connected to second rotor-housing cap 502 by bolts, such as bolt 808. Lock washers, used in conjunction with the bolts connecting first rotor-housing cap 402 to second rotor-housing cap 502, are not shown in FIG. 8A.

FIG. 8B shows a cross-sectional view of the fuel-treatment-assembly assembly shown in FIG. 8A. Motor 802 includes spindle connection 810 which connects with spindle 108. When spindle connection 810 is connected with spindle 108, the rotation created by rotation source 802 causes rotor 102 to rotate.

Once a fuel-treatment assembly is assembled and a motor is supplied, fuel input to the fuel-treatment assembly under pressure is radially accelerated. FIG. 8C shows a cross-sectional view of the fuel-acceleration chamber shown in FIG. 8A. Rotor 102 is shown rotating in a counterclockwise direction within rotor housing 202, as indicated by rotor-rotation directional arrows 812. The direction of rotation shown in FIG. 8C is arbitrary and could also be shown as a clockwise direction.

Fuel within fuel-acceleration chamber 304 is radially accelerated within the fuel-acceleration chamber 304 in the direction indicated by fuel-rotation directional arrow 814. However, the direction of fuel rotation indicated by directional arrow 814 is an overall fuel rotation. Fuel in different localized regions within fuel-acceleration chamber 304 may have different directions of movement, and may also move at different rates. For example, fuel that is nearer to rotor housing 202 will tend to move at a slower rate than fuel near rotor 102. Moreover, recesses, grooves, or protuberances may cause fuel near to rotor 102 to move in directions other than a smooth and uniform movement, or laminar flow, around rotor 102. For example, fuel near a recess may move in one of the directions indicated by directional arrows 818. Movement of fuel in the directions indicated by directional arrows 818 may produce eddies and a turbulent flow within the fuel. Cavitation within the fuel may also occur.

Figure 9A:
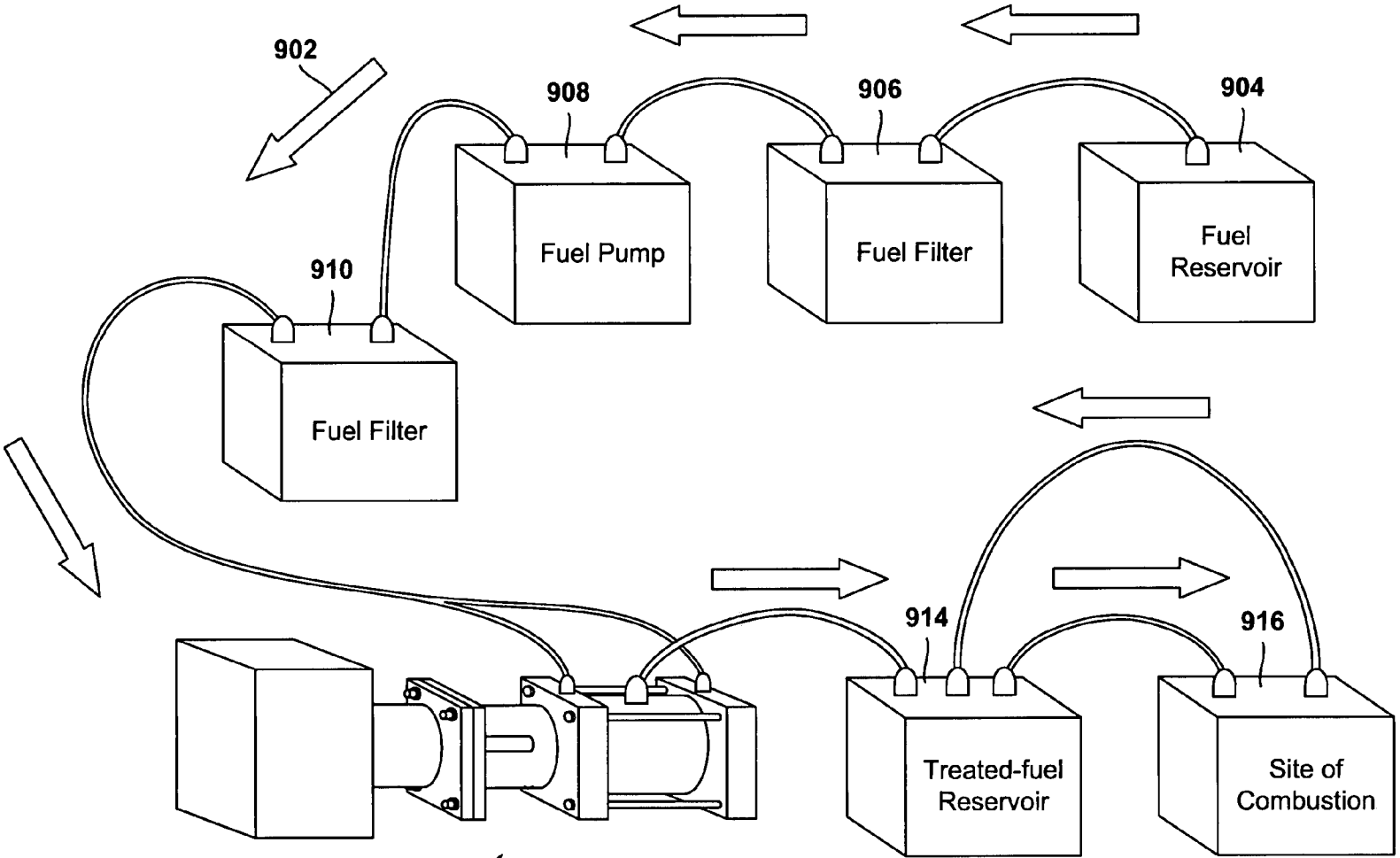
FIG. 9A shows one embodiment of a fuel-flow system from a fuel reservoir to a combustion site that includes one embodiment of a fuel treatment system.

FIG. 9A shows one embodiment of a fuel-flow system from a fuel reservoir to a combustion site that includes one embodiment of a fuel treatment system. Directional arrows, such as directional arrow 902, indicate the direction of fuel flow among the components of the system. A supply of untreated fuel is collected at fuel reservoir 904. The fuel in fuel reservoir 904 is passed to a first fuel filter 906 that removes debris from the fuel. The fuel then passes to fuel pump 908 that pressurizes the fuel. A second fuel filter 910 removes any debris which may have been introduced into the fuel subsequent to filtering by first fuel filter 906. Pressurized, filtered fuel is input to fuel-treatment assembly 912 where the fuel is treated. After the fuel is treated by fuel-treatment assembly 912, the treated fuel is passed to treated-fuel reservoir 914, from which fuel is drawn, as needed, to fuel-combustion site 916. Treated-fuel reservoir 914 contains valves that allow treated-fuel reservoir 914 to expand and contract with changing treated-fuel levels without allowing air to mix with the treated fuel. Some of the fuel that is passed to fuel-combustion site 916 is passed back to treated-fuel reservoir 914 in order to keep the fuel mixed within treated-fuel reservoir 914.

Figure 9B:
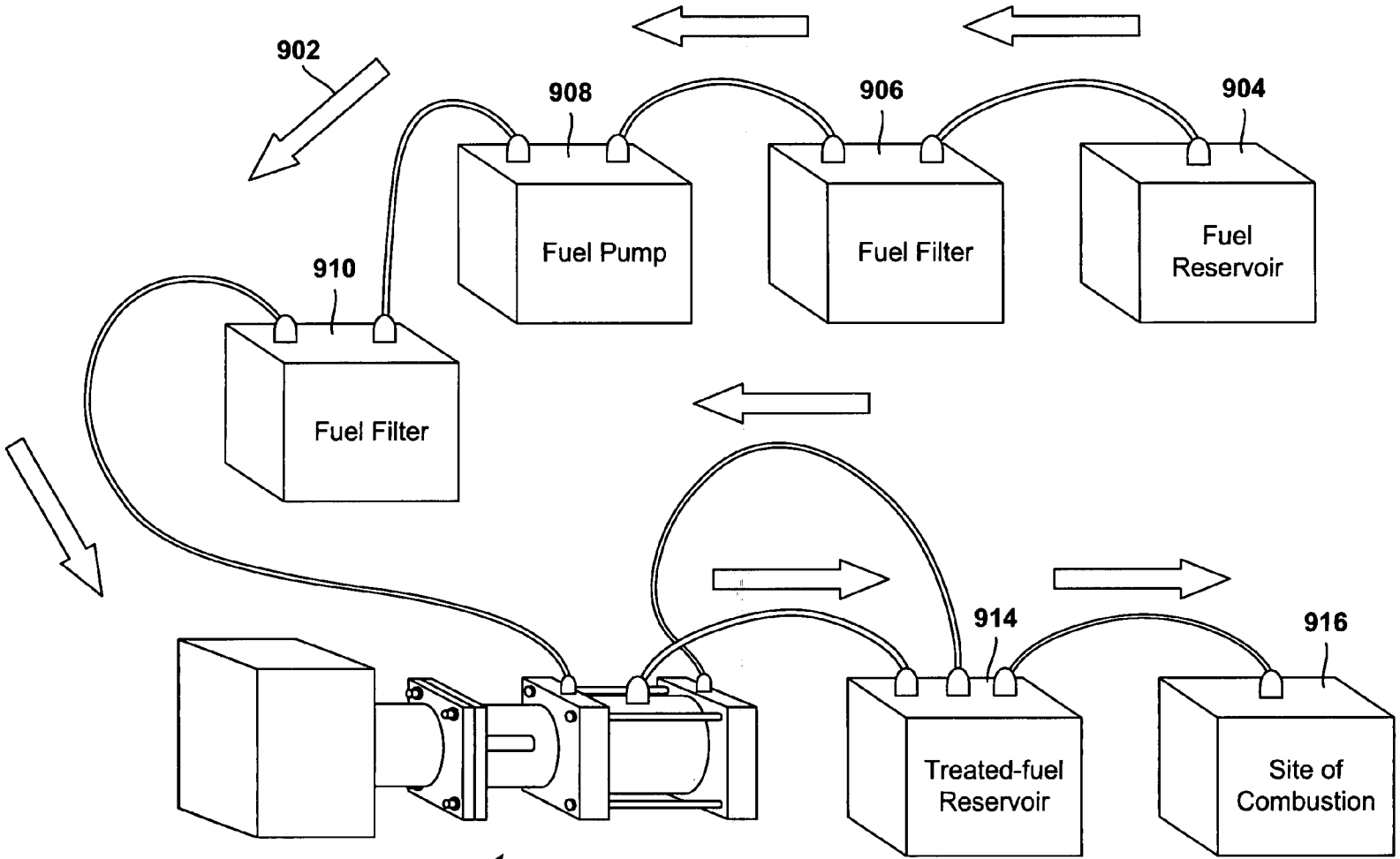
FIG. 9B shows another embodiment of a fuel-flow system from a fuel reservoir to a combustion site that includes one embodiment of a fuel treatment system.

FIG. 9B shows another embodiment of a fuel-flow system from a fuel reservoir to a combustion site that includes one embodiment of the fuel-treatment system of the present invention. FIG. 9B follows a similar path from fuel reservoir 904 to treated-fuel reservoir 914. From treated-fuel reservoir 914, fuel is passed in two directions: to fuel-combustion site 916, and also back to fuel-treatment assembly 912. Thus, in the current embodiment of the present invention shown in FIG. 9B, fuel-treatment assembly 912 receives both treated and untreated fuel.

Significant testing has been performed on prototype fuel treatment assemblies utilizing diesel fuel. Tests have been performed which vary the RPM of the rotor, the PSI of the fuel input to a fuel-treatment assembly, the types of surface features used, the width of the acceleration chamber, the diameter and number of fuel intake ports, and the diameter of the fuel outtake port. Specific values have been given for each of these variables for one specific embodiment of the fuel-treatment assembly which shows increased fuel combustion efficiency. Changing one or more of the above listed variables may be compensated for by varying one or more other variables in order to maintain improved fuel combustion efficiency. Several examples of some of the variable factors are provided below. Small adjustments to the various factors improves fuel combustion efficiency in other types of hydrocarbon-based fuels, including gasoline, kerosene, jet fuel, lubricating oil, and gas oil.

Previous tests have indicated that treating fuel in a fuel-acceleration chamber with rotor-surface features comprising rows of round recesses of incremented depth provides increased fuel combustion efficiency when various other factors are held constant at predetermined values. One factor to be considered in providing a specific type of surface feature is the type of fuel input to the fuel-treatment assembly. Different types of fuels may respond differently to different types of surface features.

Previous tests have also indicated that treating fuel in a fuel-acceleration chamber with an outtake port diameter of approximately 0.375 inches provides increased fuel combustion efficiency when various other factors are held constant at predetermined values. However, it is possible that increased fuel combustion efficiency will be maintained if the outtake port diameter is varied, and other factors are varied to compensate. For example, fuel combustion efficiency may stay elevated from baseline levels obtained with untreated fuel when outtake port 204 has a smaller diameter, and when the intake ports are also smaller. Additionally, the same increase in fuel combustion efficiency may be obtained by using two or more outtake ports of smaller diameter, rather than the single outtake port shown in FIGS. 2A-2B.

Previous tests have indicated that treating fuel in a fuel-acceleration chamber with a distance of approximately 0.1 inches between the rotor and the rotor housing provides increased fuel combustion efficiency when various other factors are held constant at predetermined values. However, it is possible that increased fuel combustion efficiency will be maintained if this distance is varied, and other factors are varied to compensate. For example, fuel combustion efficiency may stay elevated from baseline levels obtained with untreated fuel when the distance between the rotor and rotor housing is increased and the RPM of the rotor is also increased.

Previous tests have also indicated that treating fuel in a fuel-acceleration chamber with an input fuel pressure of approximately 4 PSI, with first and second intake port diameters of approximately 0.25 inches, provides increased fuel efficiency when several other factors are held constant at predetermined values. However, it is possible that increased fuel combustion efficiency will be maintained if either or both the PSI and the intake port diameters are varied, and other factors are varied to compensate. For example, fuel combustion efficiency may stay elevated from baseline levels obtained with untreated fuel when the input fuel pressure is less than 4 PSI if the intake ports are less than 0.25 inches and/or fuel is allowed to stay in the fuel-acceleration chamber for longer amounts of time. Additionally, an increase in fuel combustion efficiency may be obtained by using only one intake port of larger diameter than the two intake ports shown in FIGS. 4-5B.

Previous tests have also indicated that treating fuel in a fuel-acceleration chamber in which the rotor rotates at between 2000 and 3000 RPM provides increased fuel efficiency when several other factors are held constant at predetermined values. However, it is possible that increased fuel combustion efficiency will be maintained if another RPM is used, and other factors are varied to compensate. For example, fuel combustion efficiency may stay elevated from baseline levels obtained with untreated fuel when a lower RPM is used, but a smaller-volume fuel-acceleration chamber is used and fuel is allowed to stay in the fuel-acceleration chamber for greater amounts of time.

Fuel treatment by the above disclosed device and method produces physical changes in the fuel. The color, turbidity, and surface tension of the fuel are persistently altered.

Figure 10:
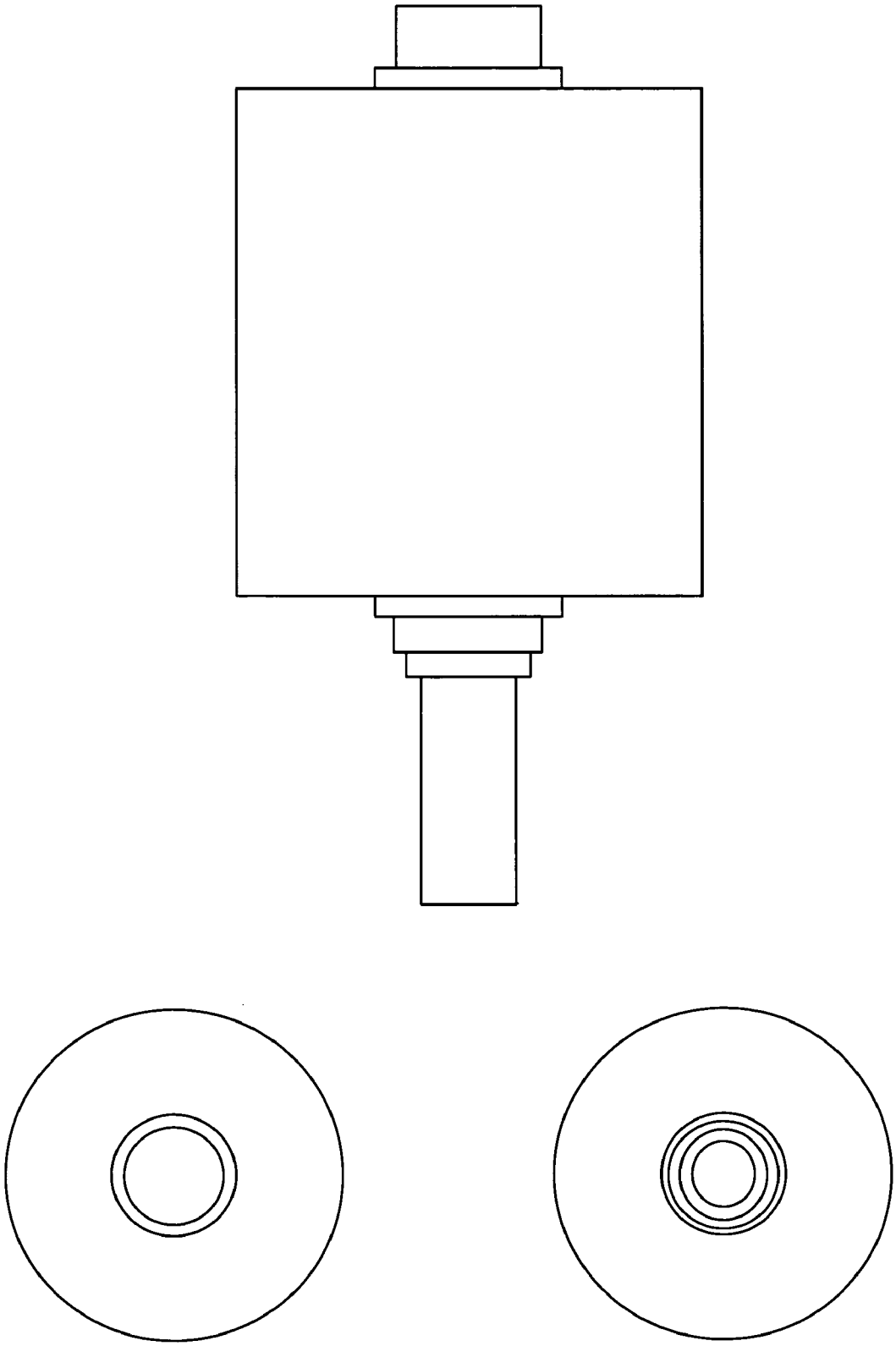
FIGS. 10-14 show another embodiment of a fuel-treatment assembly.
Figure 11:
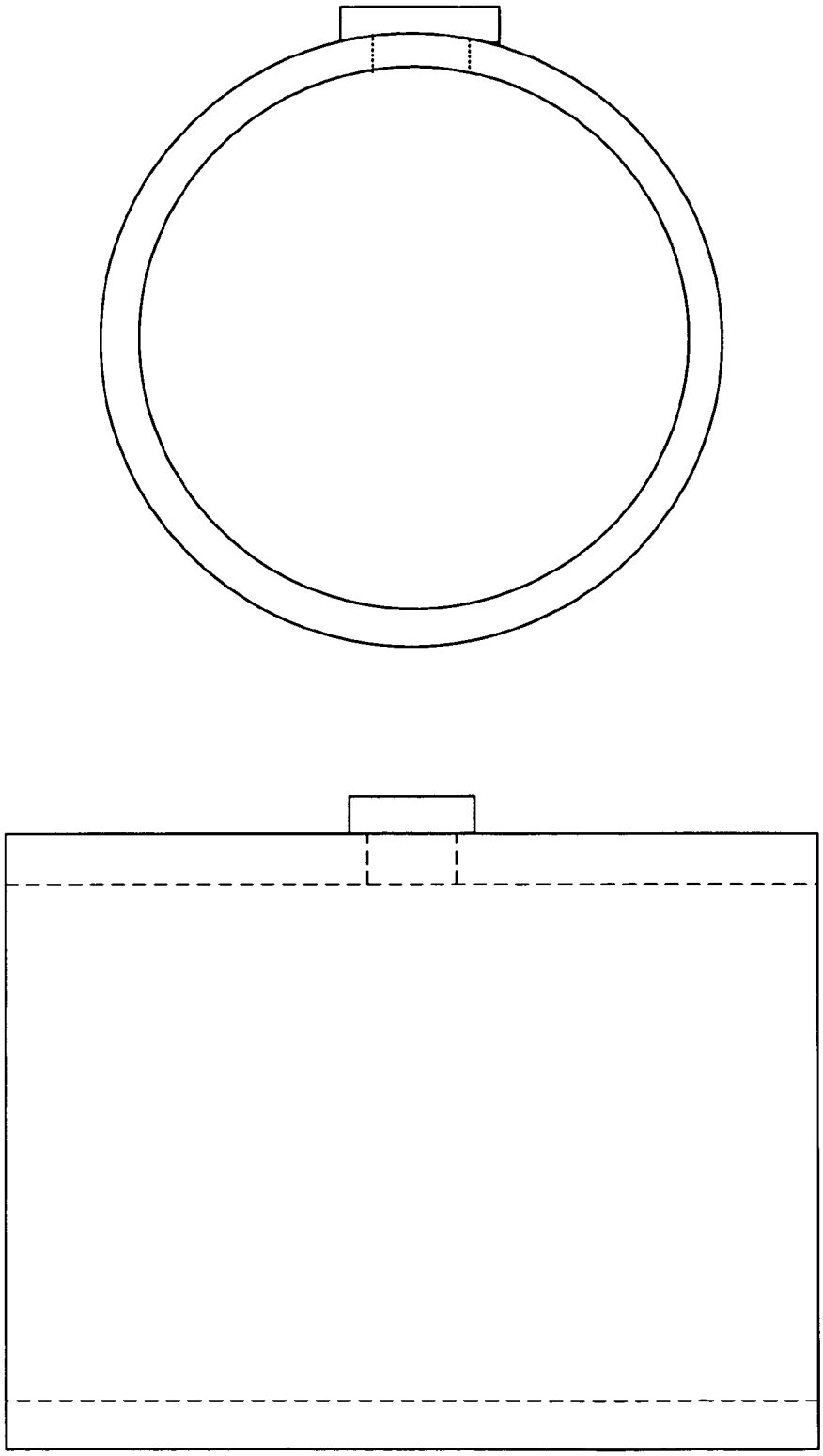
Figure 12:
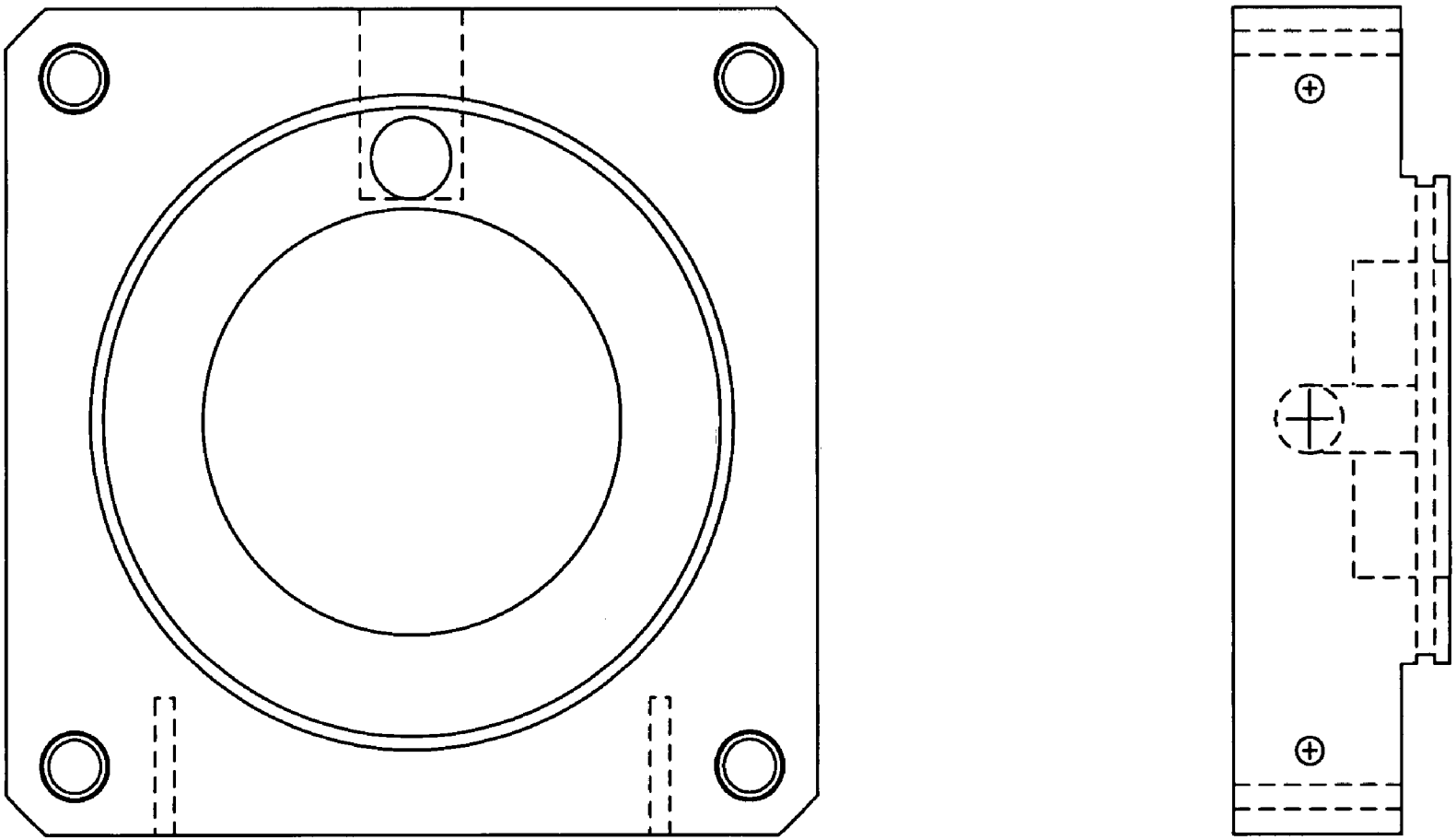
Figure 13A:
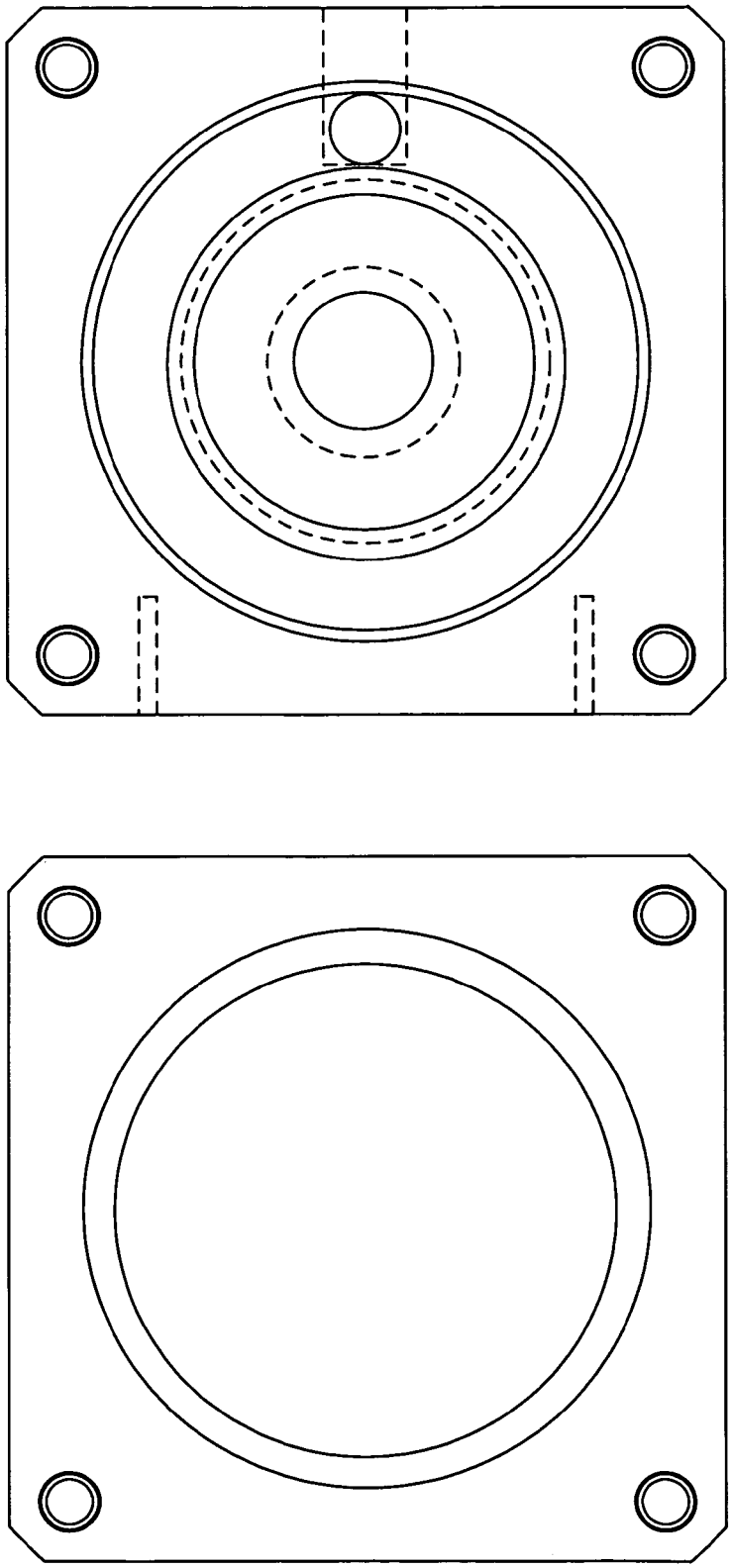
Figure 13B:
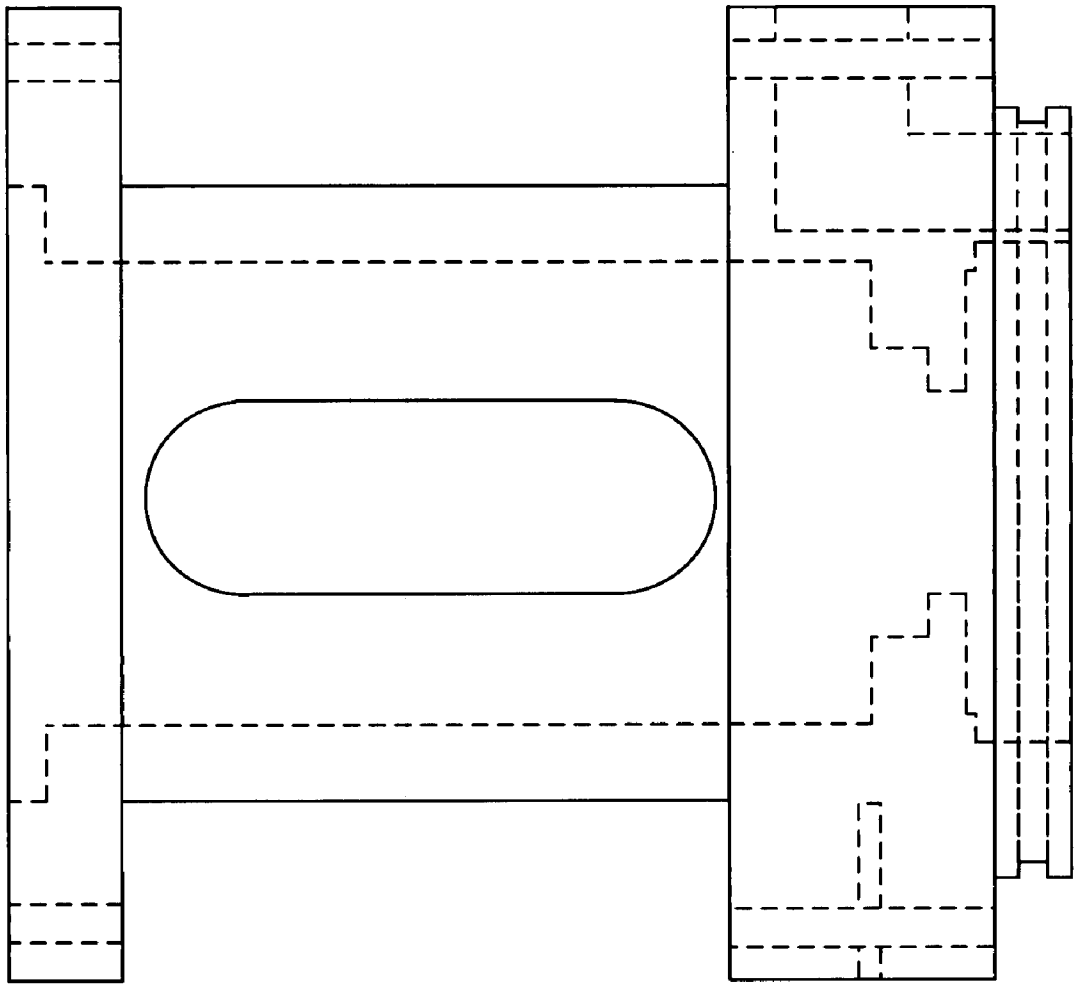
Figure 14:
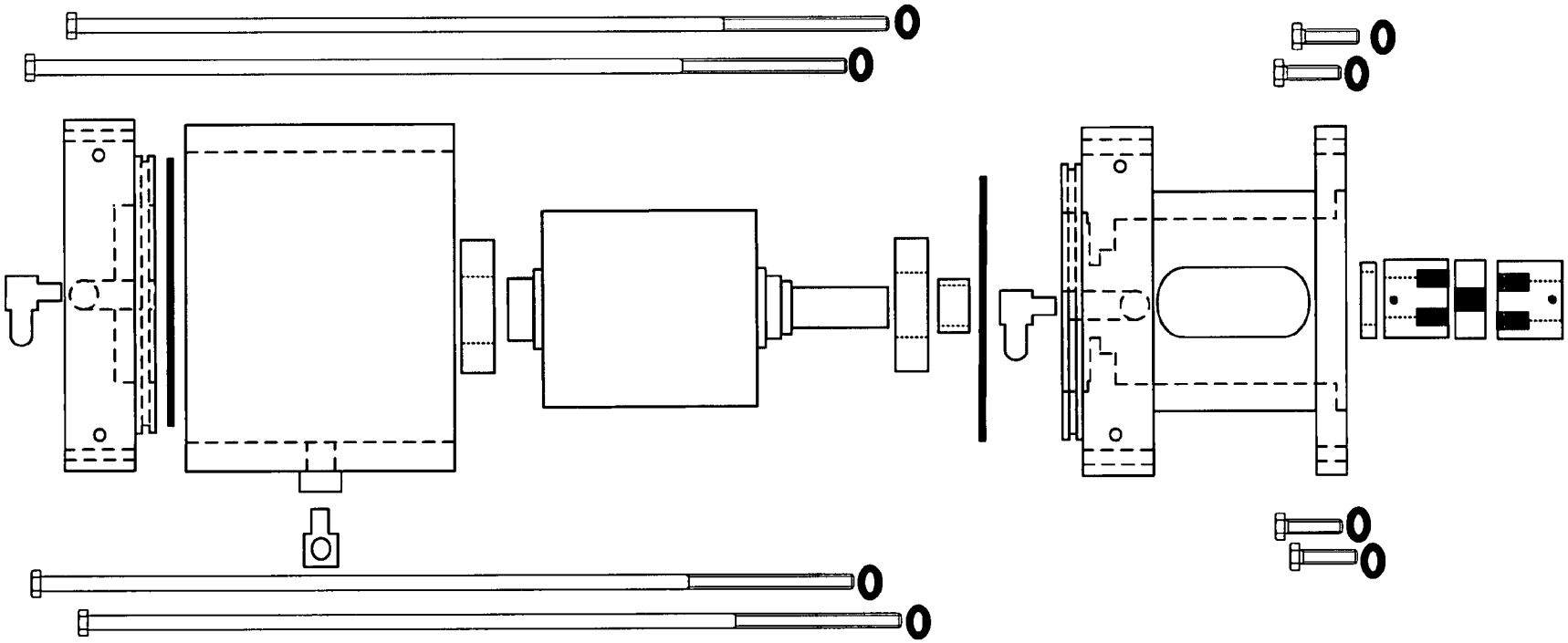

Although the present invention has been described in terms of a particular embodiment, it is not intended that the invention be limited to this embodiment. Modifications within the spirit of the invention will be apparent to those skilled in the art. An alternate embodiment of a fuel-treatment assembly is shown in FIGS. 10-14. FIG. 10 shows another embodiment of a rotor and spindle shaft. FIG. 11 shows another embodiment of a rotor housing. FIG. 12 shows another embodiment of a first rotor-housing cap. FIGS. 13A-13B show another embodiment of a second rotor-housing cap. FIG. 14 shows an exploded view of another embodiment of a fuel-treatment assembly.

In yet another alternate embodiment, air is injected into a fuel-treatment assembly. Air can be introduced into the fuel-treatment assembly at any point prior to, and including, the actual introduction of the fuel into the fuel acceleration chamber. Air can be introduced by any number of means, such as via an air compressor or a blower. For example air can be mixed with fuel while fuel is in a transportation media prior to being input to a fuel-treatment assembly, or air can be input directly into the acceleration chamber.

Other factors of a fuel-treatment assembly can be varied as well. For example, the fuel-treatment assembly can be designed so that fuel remains in the fuel-treatment assembly for various specified lengths of time. The temperature of the fuel input to the fuel-treatment assembly can be varied as well. The power supply used to power the motor can be modified to run on specific types of batteries that are commonly used for specific types of vehicles. Additional hardware can be added to a fuel-treatment assembly to mount the fuel-treatment assembly in place within a fuel delivery system for an automobile, or other vehicle. Mounting hardware may consist of various different types of fasteners including: screws, bolts, nails, epoxy, belts, and industrial straps. First and second rotor-housing caps can be fastened to each other by fastening means other than bolts.

The foregoing detailed description, for purposes of illustration, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. A fuel-treatment device for treating fuel for combustion in an internal combustion engine, the fuel-treatment device comprising:

a cylindrical fuel-processing chamber, the fuel-processing chamber having a fuel-intake port and a fuel-outtake port, the fuel-processing chamber including a cylindrical rotor with an outer surface, having either recesses, protuberances, or grooves, that conforms to an inner surface of the cylindrical fuel-processing chamber, also having either recesses, protuberances, or grooves, leaving a gap between the outer surface of the rotor and the inner surface of the cylindrical fuel-processing chamber of approximately 0.1 inches, the cylindrical gap comprising a sealed volume occupied by fuel, the rotor spun at between 2000 revolutions per minute and 3000 revolutions per minute to treat the fuel;

a fuel-pressurizing component that pressurizes untreated fuel to approximately 4 pounds per square inch;

at least one fuel-input port with a diameter of approximately 0.25 inches that allows pressurized fuel to be introduced into the cylindrical fuel-processing chamber;

at least one treated-fuel-extraction port with a diameter of approximately 0.375 inches that allows treated fuel to be extracted from the cylindrical fuel-processing chamber; and a treated-fuel reservoir that receives treated fuel without allowing air to mix with the treated fuel.

* * * * *